United States Patent [19]

Thurner AB et al.

[11] Patent Number: 4,467,652

[45] Date of Patent: Aug. 28, 1984

[54] PROCEDURE AND DEVICE FOR COMPACTION MEASUREMENT

[75] Inventors: Geodynamik H. Thurner AB, Stockholm; Åke Sandström, Sollentuna, both of Sweden

[73] Assignee: Geodynamik H. Thurner AB, Stockholm, Sweden

[21] Appl. No.: 403,761

[22] PCT Filed: Nov. 25, 1981

[86] PCT No.: PCT/SE81/00343

§ 371 Date: Jul. 23, 1981

§ 102(e) Date: Jul. 23, 1981

[87] PCT Pub. No.: WO82/01905

PCT Pub. Date: Jun. 10, 1982

[30] Foreign Application Priority Data

Nov. 26, 1980 [SE] Sweden ..... 8008299

[51] Int. Cl.[3] ..... G01N 3/52; E02D 3/046

[52] U.S. Cl. ..... 73/573; 73/594; 73/78; 404/133

[58] Field of Search ..... 73/573, 594, 78, 84; 404/122, 133

[56] References Cited

U.S. PATENT DOCUMENTS 3,599,543 8/1971 Kerridge ..... 404/117

3,775,019 11/1973 Konig, et al. ..... 404/133

4,103,554 8/1978 Thurner ..... 73/573

FOREIGN PATENT DOCUMENTS 1372567 10/1974 United Kingdom .

*Primary Examiner*—James J. Gill

*Attorney, Agent, or Firm*—Brumbaugh, Graves, Donohue & Raymond

[57] ABSTRACT

The invention refers to a procedure and a device for measuring the degree of compaction attained when compacting a foundation by means of a vibrating compaction tool. The movement of that part of the compaction tool which rests on the foundation is sensed and analyzed. The time interval elapsing between successive passages of the movement signal through the zero point or other reference level is measured. Alternatively, the ratio between the absolute values of the extreme positive and extreme negative values of the motion in relation to the said level is also measured. By means of the relative magnitudes of these time intervals and amplitude relationships respectively a quantity is formed which comprises a measure of the degree of compaction of the foundation. The invention also refers to electronic devices which sense the movement and calculate the time intervals and amplitude relationships and calculate a quantity as a function of these, which comprises a measure of the degree of compaction attained in the foundation.

10 Claims, 5 Drawing Figures

PROCEDURE AND DEVICE FOR COMPACTION MEASUREMENT

TECHNICAL AREA TO WHICH THE INVENTION RELATES

The present invention refers to a procedure and a device for measuring the degree of compaction achieved when compacting a foundation by means of a vibrating compaction tool. The compaction tool may be a roller with at least one cylindrical drum which is caused to oscillate by means of an eccentric weight rotating inside it.

BACKGROUND TO THE INVENTION AND TECHNICAL STANDPOINT

If the degree of compaction achieved with a vibrating compacting tool can be measured simply and continuously, and if the frequency and amplitude of the vibration of the compaction tool, as well as the speed with which the tool is moved across the foundation, can be varied, it would be possible to control the compaction tool with the aim of attaining optimal compaction. The danger of terminating compaction before a sufficient degree of compaction has been attained, or continuing compaction although a sufficient degree of compaction has already been attained, could be minimized. There has therefore long existed a need for a simple, inexpensive and reliable continuously measuring compaction degree meter for vibrating tools. In the patent literature there are many more or less different proposed designs of compaction degree meters. Among those that may be of interest as a background to the present invention, the ones described in British Pat. No. 1,372,567 and U.S. Pat. Nos. 3,599,543 and 4,103,554, for example, may be mentioned.

BRIEF DESCRIPTION AND SUMMARY OF THE INVENTION

The invention is based on sensing at least the vertical component of the movement of that part of the compaction tool which rests on the foundation and carries out compaction. If the compaction tool is moved across a flat, homogeneous, extremely soft and completely resilient foundation, the aforementioned vertical component of the movement would be a purely sinusoidal movement with respect to time for the majority of conventional compaction tools. On the other hand, if the compaction tool is moved back and forth across a stretch of the foundation consisting of soil or asphalt then at least initially a gradual increase in rigidity would be achieved in the foundation. Owing to the dynamic interaction between the compaction tool and the foundation, the aforementioned vertical movement would increasingly deviate in shape from the purely sinusoidal form with increasing rigidity of the foundation. This deviation from a sinusoidal form is—if all parameters in the compaction tool remain constant—directly related to the dynamic characteristics of the foundation and primarily its rigidity.

Through the aforementioned U.S. Pat. No. 4,103,554 it is already known that from the output signal of a transducer which senses the aforementioned movement it is possible to filter out sub-signals, the frequency of which essentially coincides with the basic frequency of the vibration and its harmonics. According to the aforementioned patents there exists a relationship between the amplitudes of these sub-signals and the degree of compaction.

Even though compaction meters according to U.S. Pat. No. 4,103,554 often work well, at least in certain connections, they do have certain disadvantages. For example, if it is desired to vary the vibration frequency of the compaction tool it is necessary to have either exchangeable band-pass filters or band-pass filters with controllable pass-band frequencies, which renders the meter more complicated and more expensive. Another drawback is that it is based on the concept that the basic frequency of the vibration is the lowest frequency in the movement performed by the vibrating and compacting part of the compaction tool.

The present invention is based on the insight that the relative magnitudes of the time intervals between at least certain successive passages through the zero point of the said movement, or signals from the transducer sensing the movement, display a relationship with the degree of compaction of the foundation. The invention is also based on the insight that the basic frequency of the vibration is not the lowest frequency of the movement performed by the vibrating and compacting part of the compaction tool. Depending on the type of compaction tool, lower frequencies may exist in the movement, including those depending on the degree of compaction of the foundation as well as those having poor relationship with the degree of compaction and stemming principally from the design and operation of the compaction tool.

According to the invention the magnitude of the time interval between two or more successive passages through the zero point of a signal from a transducer, which senses the movement of a vibrating part of the compaction tool which comes into contact with and compacts the foundation, is measured. By means of the relative magnitudes of the said time intervals a quantity is formed which comprises a measure of the degree of compaction achieved in the foundation. Without further explanation it will no doubt be realized that when using suitable time measurement devices it is not necessary to reset the compaction degree meter or adapt it to the vibrations frequency.

The invention does not utilize the absolute amplitude of the movement, with the result that any changes in the sensitivity of the transducer or the amplification of the signal on account of aging, varying temperature, etc. are of no significance. On the other hand, the relative amplitude of the movement can be utilized in certain versions of the invention.

The invention will be described mainly with reference to a version for cases where the compaction tool consists of a roller with a cylindrical drum which is caused to oscillate by means of a weight rotating inside it which is eccentrically located in relation to the symmetric axis of the drum. The acceleration of the drum in a vertical direction is recorded by an accelerometer mounted on one of the bearing houses of the eccentric shaft; c.f. the previously mentioned U.S. Pat. Nos. 3,599,543 and 4,103,554.

DETAILED DESCRIPTION OF THE PREFERRED EMBODIMENTS

Figure 1:
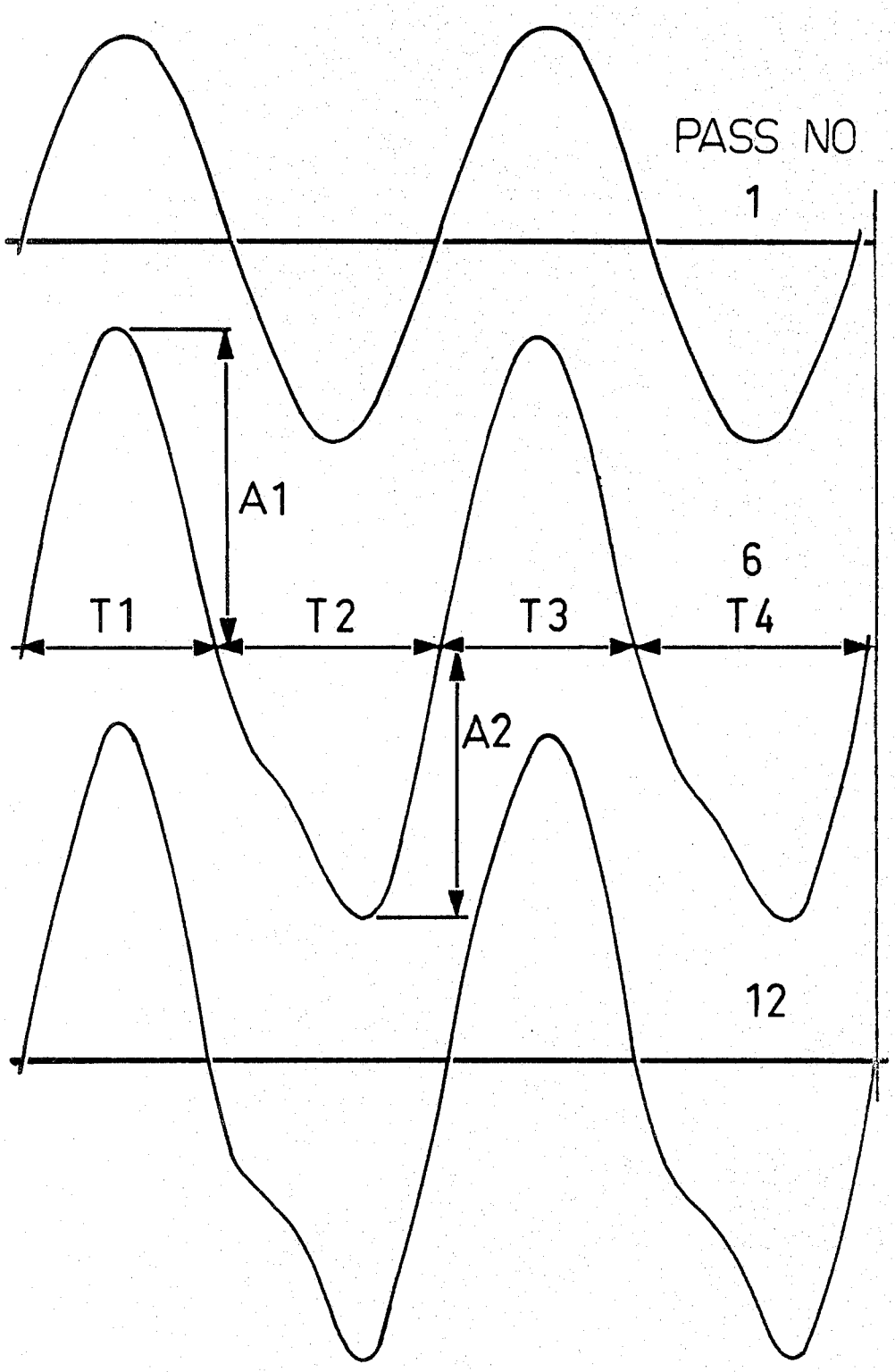
FIG. 1 shows examples of signals from a transducer
Figure 2:
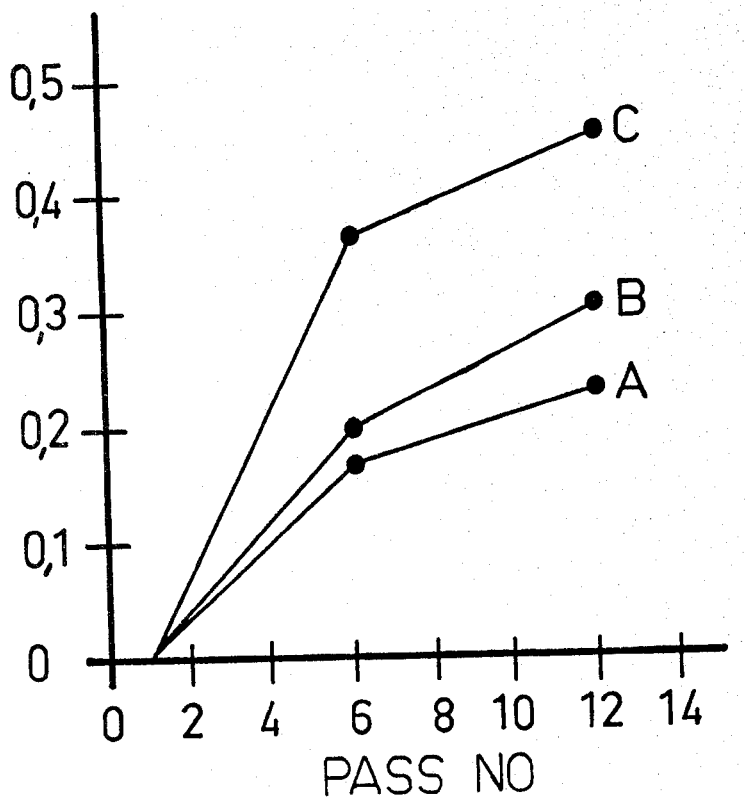
FIG. 2 shows the values of quantities formed by the relative magnitudes of successive time intervals between passages through the zero point

Shown in FIG. 1 are examples of signals recorded in this way during the first, sixth and twelfth pass on a foundation consisting of non-cohesive soil. Owing to the dynamic interaction between the various parts of the roller and the foundation the signal will increasingly deviate in shape from the sinusoidal form obtained when the roller moves across a soft and completely resilient foundation as the rigidity of the foundation increases. This deviation from sinusoidal form is—if all roller parameters are constant—related to the dynamic properties of the foundation and primarily its rigidity. The magnitude $1-T1/T2$ or $T2/T1-1$ as in FIG. 1 shows good significance when correlated with the degree of compaction according to studies that have been conducted. An advantage of this quantity is also that it can be calculated to a high degree of accuracy with a comparatively simple electronic device. In practice, the parameter value is calculated as a mean value of a certain number of periods of the oscillation in order to get away from the effect of cyclic variations in the zero level of the signal and random variations in the signal. FIG. 2 shows the parameters $1-T1/T2$ (curve A) and $T2/T1-1$ (curve B) as a function of the number of passes calculated from the recorded signals as shown in FIG. 1. The respective parameters have here been calculated as mean values over two periods. The result shows a parameter value increase which in principle corresponds to the compaction degree increase with an increasing number of passes completed.

Figure 3:
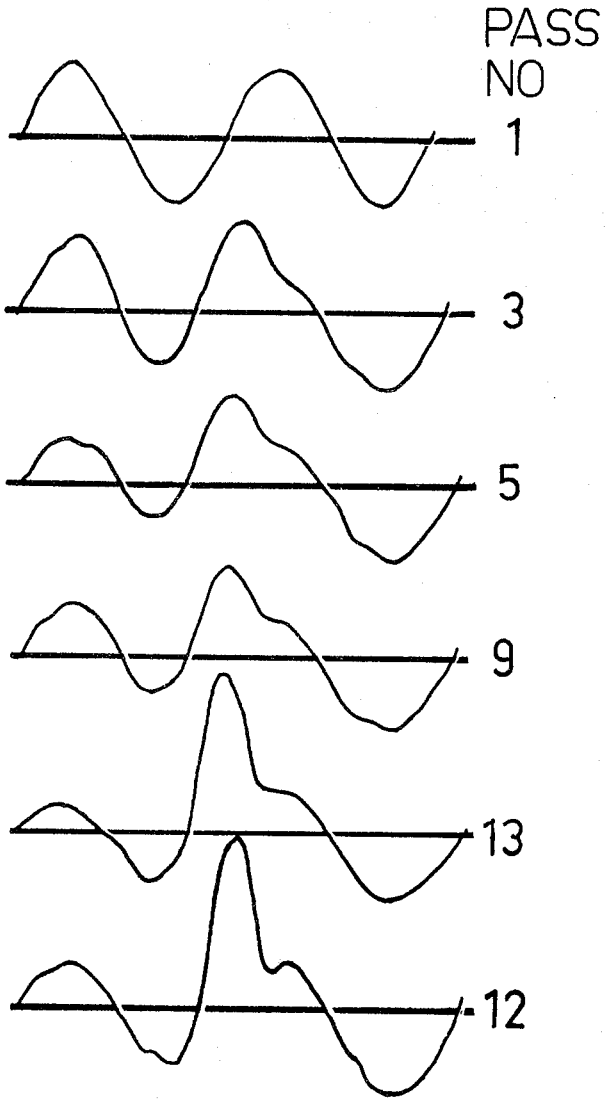
FIG. 3 shows examples of signals from a transducer when the roller has such a combination of parameters (static load, dynamic load, total weight, frame rigidity, power transmission, etc) that a state of oscillation arises

Certain combinations of roller parameters produce oscillation sequences like those in FIG. 3, which may be due to the drum performing double jumps or entering a state of rocking oscillation. In the latter case this effect can be eliminated for the most part by recording the acceleration of both sides of the drum simultaneously and carrying out the analysis on the mean value of the two signals; i.e. the movement of the center point of the drum is analysed. In these cases it is under all circumstances important to calculate the parameter in question as the mean value of two periods or a multiple of two periods. Normally, the parameter is calcuated as a mean value of a large number of periods in order to reduce the risk of random variations.

Figure 4:
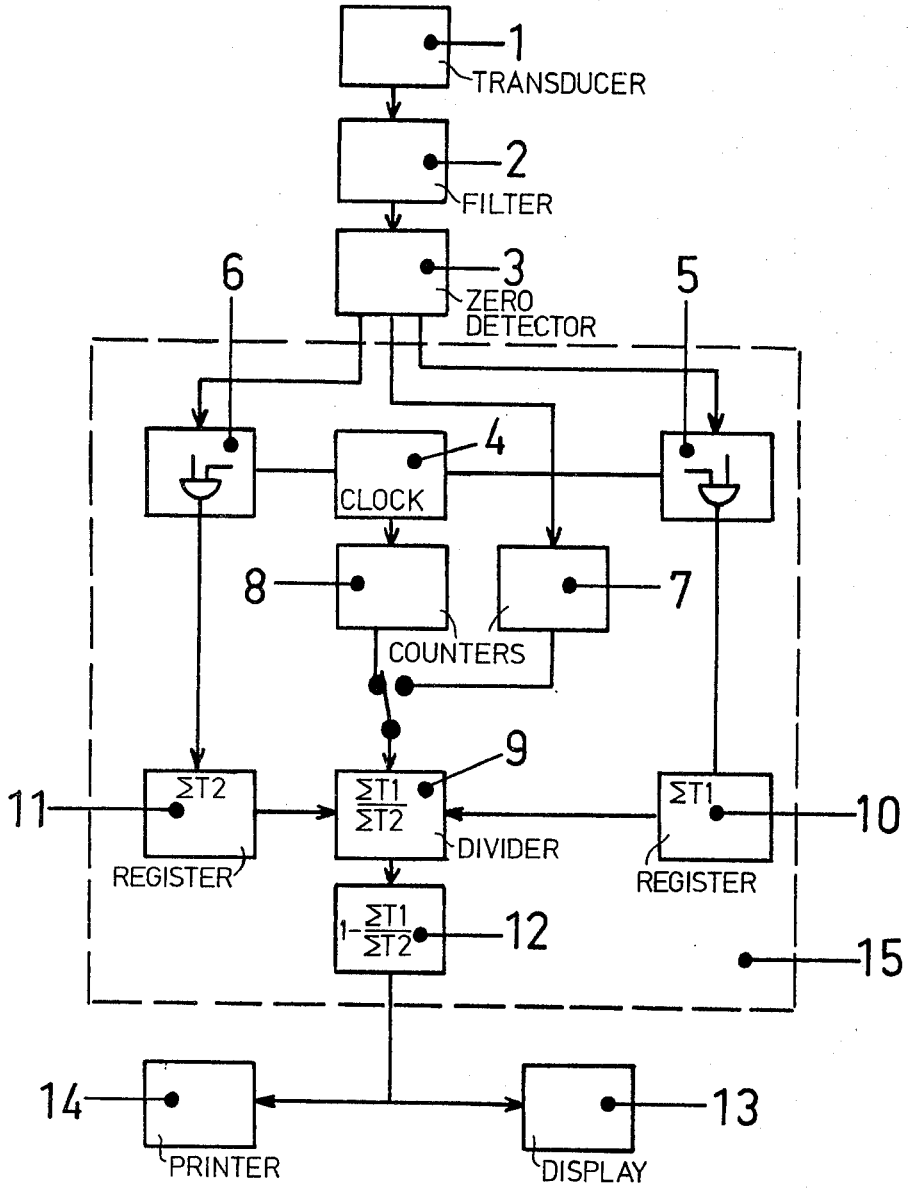
FIG. 4 shows in block diagram form the configuration of a version of a device according to the invention

A device which calculates and presents the result according to the invention can be arranged in several different ways. Two different main versions may be distinguished, one which is based solely on analogue signal processing and one in which the actual calculation of the relevant parameter takes place digitally. FIG. 4 shows in block diagram form the configuration of a device according to this latter version.

An electrical signal which describes the movement of the drum is generated in transducer (1), which may suitably consist of an accelerometer mounted vertically on the vibrating part of the compaction tool. In certain cases it may be advantageous for two transducers to be averaged in such a manner that a signal corresponding to the vertical movement of the centre of gravity of the vibrating portion is generated. Disturbing low-frequency and high-frequency oscillations are filtered out in block (2). Low-frequency oscillations arise by the compaction tool travelling over an uneven surface, for example, or by the frame of the tool entering a state of oscillation. High-frequency disturbances arise as a result of reasonance in the structure and bearing play. Block (3) detects passages through the zero point in the signal. This block also contains a device which blocks the zero detector for a length of time corresponding to half the shortest period that can occur. This is to avoid spurious zero detection occurring on account of superposed high-frequency disturbances remaining after (2). Two outgoing signals which control two gates (5) and (6) go out from (3). Gate (5) is open and allows pulses from the clock (4) to pass through when the signal from (2) is above the zero level and gate (6) lets through clock pulses when the signal level is below zero. The pulses from the gates are counted for a definite period of time and stored in two registers (10) and (11). After the predetermined time the contents of the registers are transferred to a digital divider section, following which the registers are reset to zero and begin to count pulses afresh. The predetermined time for forming the mean value can be generated by the transducer signal so that it comprises a definite multiple of the periodicity of the main oscillation, which can be implemented with a counter (7) or, alternatively, the average time is determined by the clock via a counter (8) so that mean value formation takes place for a definite time asynchronously with the periodicity of the oscillations of the compaction tool. In the divider section the two digital values are divided by each other, following which the parameter value (1−ratio) is calculated in block (12). The digital parameter value is presented on a display and/or a printer ((13) and (14)). The digital parts of the device (15) can be constructed from standard TTL or CMOS components but may to advantage consist of a microprocessor.

So far it has been assumed that the output signal from a transducer which senses a part of the movement of the compaction tool at least after a certain signal processing comprises a distorted sinusoidal signal, in which the distortion is due to the rigidity, etc of the foundation. Theoretically, other transducers are conceivable which generate a sinusoidal signal superposed on a constant or nearly constant signal. In theory at least, such a signal could in electrical form always be of the same polarity but of varying amplitude. Theoretically, it is also conceivable that a superposed signal arises on account of the compaction tool moving up or down an incline. In such cases the passages through the zero point of the signal, to the extent that they occur, naturally do not constitute a good point of departure for measuring the degree of compaction. According to the invention, however, the same technique can be applied as in the case of the distorted sinusoidal signal if times when the submovement signal coincides with a reference value or when it rises above or falls below a reference value are sensed or detected instead of the passages through the zero point of the signal. The requirement here is that the reference value comprises the arithmetical mean value of the sub-movement signal calculated or obtained over suitable length of time. One method of ensuring that such a reference value coincides with zero is of course high-pass filtration of the sub-movement signal. The pass-band of the high-pass filter should then allow signals with a considerably lower frequency than the fundamental frequency of the vibration to pass through, and preferably also signals with a frequency which is a fraction of the fundamental frequency of the vibration. On the other hand, zero frequency and direct current components, i.e. chiefly stationary components of the sub-movement signal, should be filtered out effectively.

The simplest version of a procedure or a device according to the invention is based on the quantity 1 minus the relationship between the magnitudees of two consecutive time intervals. The transducer should preferably be oriented so that the polarity of the signal will be as in the example in FIG. 1. The ratios T1/T2 and T3/T4 will then be less than one if T1 and T3 are defined as times during which the signal level is above zero and a certain reference value respectively and T2 and T3 are defined as times during which the signal level is below the said level. In certain connections it is preferable to measure several time intervals and form subquantities as above.

The quantity used as a measure of the degree of compaction is then formed as an arithmetical and/or geometrical mean value of the subquantities. Alternatively, all time intervals during which the signal is above zero or a reference value and the corresponding time interval during which the signal is below the said value can first be summed individually for a definite period of time or a definite number of cycles, following which the desired quantity is calculated as 1 minus the ratio between the two sums.

A more complicated version of the invention than those so far described is based on also measuring and utilizing the relative amplitudes of the acceleration motion as well. The relative amplitudes of the acceleration motion are understood in this connection to be the size relationship H between the maximum amplitudes of the motion, or deviations from the mean value in the event that the mean value is not zero over an entire period, during the time interval between consecutive passages through the zero point and times when the momentary value coincides with the mean value respectively in the said cases. In FIG. 1 the absolute amplitudes A1 and A2 during the time intervals T1 and T2 respectively are shown. According to the invention, although the absolute values A1 and A2 in the accelerometer signal are measured, it is the relative magnitude H=A1/A2 which is of significance for the degree of compaction. Several different functions of H and the relative magnitude of time intervals T1 and T2 are conceivable as an output quantity and measure of the degree of compaction achieved, for example $$\frac{H \cdot T2 - T1}{T1}; \frac{H \cdot T2 - T1}{T1 + T2} \text{ and } \frac{H \cdot T2 - T1/H}{T1 + T2}$$

Other powers of H and T1/T2 besides 1 are also conceivable. Shown in FIG. 2 as an example is the quantity (H·T2−T1)/T1 as curve C. One version of an alternative version is described below.

Figure 5:
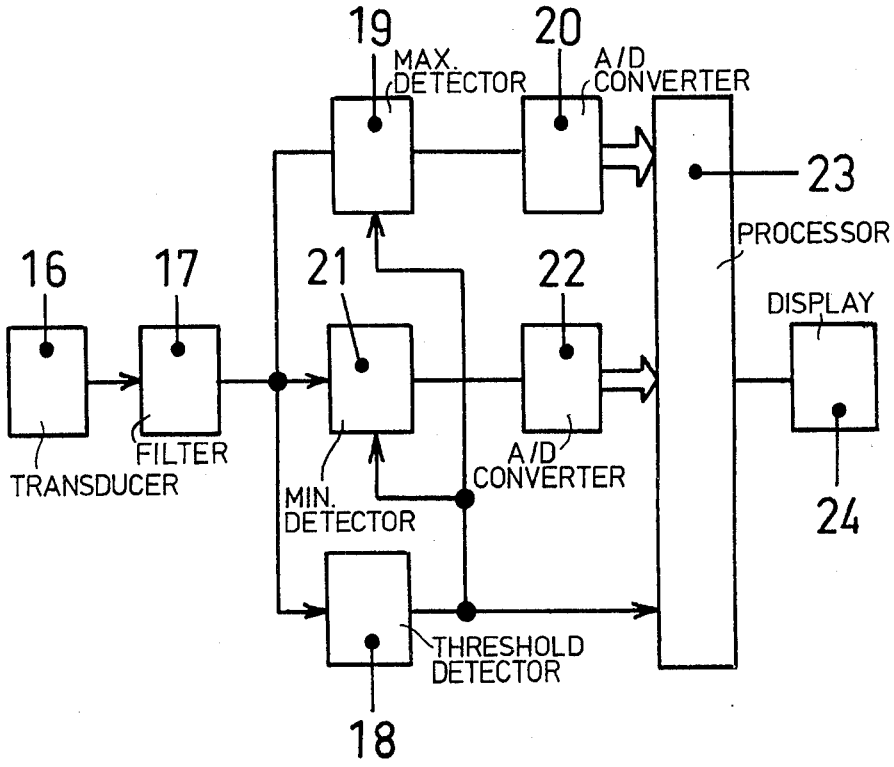
FIG. 5 shows in block diagram form the configuration of an additional version of a device according to the invention

The movement of the drum is sensed and filtered by means of a transducer 16 and a filter 17 as in FIG. 5 in the manner described with reference to the version as in FIG. 4. Passage of the signal through the zero point or other reference level is detected by a threshold detector 18. The maximum value of the signal between two passages through the signal zero point is determined in a peak value detector 19 which is reset every time the signal passes the reference level which is detected by the threshold detector 18. The maximum value is converted into a digital value by analogue-to-digital converter 20. In a corresponding manner the minimum value of the signal between two passages of the reference level is sensed in block 21. The minimum value is converted by the analogue-to-digital converter 22 into a digital value. Detected passages through the reference level in the form of pulses from 18 reset the maximum value detector 19 and the minimum value detector 21 to zero. The pulses from threshold detector 18 and the digital values from the converters 20 and 21 are connected to a processor 23. The value of the output quantity in question is calculated in processor 23, after which the value is presented on display unit 24.

It is easy for the expert to construct a device or carry out a procedure according to the invention with commercially available discrete components and integrated circuits. From manuals, data sheets and other information supplied by manufacturers and/or sellers of electronic components such as Texas Instruments, Fairchild, Motorola, etc it is evident which components can be used, such as threshold detectors, comparators, counters, dividers, multipliers, filters, amplifiers, clocks, etc. It is also evident which modifications and additions are needed to adapt the components to different frequency ranges. From information supplied by manufacturers and/or sellers of vibrating compaction tools such as vibratory rollers the data which the expert needs in order to apply the invention when compacting with them will be evident. From the aforementioned patents it is evident how transducers for sensing the movement of the compaction tool can be mounted. From these, examples of usable transducers are also evident as well as how more than one transducer can be used simultaneously in order to reduce the effect of certain disturbances. It is therefore probably unnecessary to specify components and circuits in detail.

I claim:

1. A procedure for measuring the degree of compaction attained when compacting a foundation with a compaction tool having a vibrating section which in contact with the foundation and moving along it compacts the foundation, in which connection a submovement signal representing at least the most rapidly varying vertical component of the movement of the compacting section is generated, characterized by sensing of points in time when the submovement signal coincides with a reference value by the formation of a quantity as a function of the magnitude of the time interval between successive points in time during which the submovement signal coincides with the reference value, which quantity is used as a measure of the degree of compaction.

2. A procedure as in claim 1, characterized in that the function is a constant reduced by the relationship between the magnitudes of two time intervals.

3. A procedure as in claim 1, characterized by sensing when the submovement signal is above the reference value and is below the reference value and in that the function comprises a mean value formed as a constant reduced by the relationship between the sum of a number of time intervals during which the signal is above the reference value and the sum of the same number of time intervals during which the signal is below the reference value.

4. A procedure as in claim 1, characterized in that the function comprises a mean value of a number of subfunctions each of which is the difference between a constant and the relationship between the magnitudes of two time intervals.

5. A procedure as in claim 1, characterized in that the extreme positive and extreme negative values of the submovement signal are also sensed in relation to the reference level and that the quantity is formed as a function of the said extreme values also.

6. A device for measuring the degree of compaction attained when compacting a foundation with a compaction tool having a vibrating section which in contact with the foundation and moving along it compacts the foundation, comprising transducer means on the compaction tool for generating a submovement signal representing at least the most rapidly varying vertical component of the movement of the compacting section, means for sensing points in time when the submovement signal coincides with a reference value, in which connection the said reference value at least for the most part coincides with the mean value of the submovement signal, and function-forming means for the formation of a quantity as a function of the magnitude of the time interval between successive points in time during which the movement signal coincides with the reference value, which quantity comprises a measure of the degree of compaction.

7. A device as in claim 6, characterized in that the function-forming means form the quantity as a function of a constant reduced by the relationship between the magnitudes of two time intervals.

8. A device as in claim 6, comprising means for sensing when the submovement signal is above the reference value and is below the reference value, and characterized in that the function-forming means form the quantity as a mean value calculated as a constant reduced by the relationship between the sum of a number of time intervals during which the signal is above the reference value and the sum of the same number of time intervals during which the signal is below the reference value.

9. A device as in claim 6, characterized in that the function-forming means form the quantity as a mean value of a number of subquantities, each of which comprises a function of the difference between a constant and the relationship between the magnitudes of the time intervals.

10. A device as in claim 6, characterized by elements (19,20) for sensing successive extreme positive and extreme negative values of the submovement signal during the time interval, and in that the function-forming means (23) form the quantity as a function of the extreme values also.

* * * * *

UNITED STATES PATENT AND TRADEMARK OFFICE

CERTIFICATE OF CORRECTION

PATENT NO. : 4,467,652

DATED : August 28, 1984

INVENTOR(S) : Åke Sandström

It is certified that error appears in the above-identified patent and that said Letters Patent is hereby corrected as shown below:

First page, Item [75], "Geodynamik H. Thurner AB, Stockholm; Åke Sandström, Stollentuna, both of Sweden" should read -- Åke Sandström, Sollentuna, Sweden --;

First page, Item [86], "Jul. 23, 1981" should read -- Jul. 23, 1982 -- (both occurrences);

Column 6, line 47, after "value" insert -- , and --.

Signed and Sealed this

*Twenty-sixth* Day of *February 1985*

[SEAL]

*Attest:*

DONALD J. QUIGG

*Attesting Officer* *Acting Commissioner of Patents and Trademarks*